US005476209A

United States Patent [19]

Kojima et al.

[11] Patent Number: 5,476,209

[45] Date of Patent: Dec. 19, 1995

[54] PROCESS OF PREPARING COMPOSITE WIRE

[75] Inventors: Kiyokazu Kojima; Hisao Iida; Hidekazu Yanagisawa; Wataru Wada, all of Kanagawa, Japan

[73] Assignee: Tanaka Kikinzoku Kogyo K.K., Japan

[21] Appl. No.: 258,527

[22] Filed: Jun. 10, 1994

[30] Foreign Application Priority Data

Jun. 11, 1993 [JP] Japan ..... 5-166272
Jun. 11, 1993 [JP] Japan ..... 5-166273
Dec. 10, 1993 [JP] Japan ..... 5-341613

[51] Int. Cl.[6] ..... B23K 20/14

[52] U.S. Cl. ..... 228/131; 228/156; 228/186; 228/221

[58] Field of Search ..... 228/131, 156, 228/186, 221

[56] References Cited

U.S. PATENT DOCUMENTS 1,392,416 10/1921 Henderson ..... 228/186
3,698,050 10/1972 Rubin ..... 445/49
3,913,208 10/1975 Colombi et al. ..... 228/156 X
4,744,504 5/1988 Turner ..... 288/156 X
5,261,591 11/1993 Hardwick ..... 228/156 X

FOREIGN PATENT DOCUMENTS 202721 9/1986 Japan ..... 228/186

*Primary Examiner*—Kenneth J. Ramsey
*Attorney, Agent, or Firm*—Klauber & Jackson

[57] ABSTRACT

Disclosed is a process of preparing a composite wire which comprises sealing one end of a pipe to be employed as a jacket, inserting a bar to be employed as a core into the pipe and conducting a hot processing of the pipe while vacuum-sucking the pipe from the other end thereof. In accordance with the present invention, the strength of the resulting composite wire is sufficient, and the number of operations can be reduced, that is, the wire can be prepared under the excellent workability and productivity.

6 Claims, No Drawings

PROCESS OF PREPARING COMPOSITE WIRE

BACKGROUND OF THE INVENTION

The present invention relates to a process of preparing a composite wire preferably employed for a lead wire of such a sensor as a temperature sensor and an oxygen sensor.

A wire composed of platinum or its alloy has been employed for the above sensors. However, the recrystallization temperature of the platinum or its alloy is disadvantageously low so that the crystal structure grows to lower the strength when a temperature raises to 400° C. or more.

In order to overcome this disadvantage, an Fe-Ni alloy or molybdenum which is resistant to a high temperature having a platinum plating on the surface thereof is employed. However, other drawbacks of the occurrence of corrosion through pinholes and of cracks along bending portions may be produced.

Conventionally, a composite wire has been prepared by inserting a metal pipe to be employed as a jacket into a metal billet to be employed as a core, extruding and drawing it, or by inserting a metal pipe to be employed as a jacket into a metal rod to be employed as a core and repeating pultrusion and annealing.

In case of the extrusion, however, depending on the metal, for example, when an alloy consisting of W-Mo-Fe-Ni which has high strength at a high temperature is employed, the extrusion can be hardly carried out to perform the stable production due to the blockage of the extrusion metal.

On the other hand, in case of the pultrusion and the annealing, the sufficient bonding strength cannot be obtained because the penetration of a drawing lubricant, air and a gas.

Further, due to the difference of the workability (malleability) between the jacket and the core, the workability and the productivity are low because the peeling, the cracking and the cutting of the wire are likely to occur during the drawing process so as to provide insufficient processing and to require several thermal treatments.

SUMMARY OF THE INVENTION

An object of the present invention is to provide a process of preparing a composite wire substantially free from the above drawbacks.

Another object is to provide a process of preparing a composite wire having a sufficient strength.

A further object is to provide a process of preparing a composite wire under the excellent workability and productivity.

One aspect of the present invention is a process of preparing a composite wire which comprises sealing one end of a pipe to be employed as a jacket, inserting a bar to be employed as a core into the pipe and conducting a hot processing of the pipe while vacuum-sucking the pipe from the other end thereof.

The other aspect of the present invention is a process of preparing a composite wire which comprises sealing one end of a pipe to be employed as a jacket, inserting a bar to be employed as a core having an oxidation-resistant thin metal coating on its surface into the pipe, conducting the drawing thereof to tightly stick the pipe with the core, heating it while vacuum-sucking the pipe from its other end to achieve the vacuum deaeration, sealing the other open end of the jacket, then cladding the jacket and the core by means of a high-temperature and high-pressure treatment, and drawing the treated jacket and core.

Since, in accordance with the first aspect of the process of the invention, no penetration of a lubricant, air nor a gas occurs during the drawing operation by conducting the vacuum-sucking of the jacket and the core inserted into the jacket one end of which is sealed and no oxidation occurs even in the hot processing, the sufficient strength can be produced, the number of operations can be lowered and the wire can be prepared under the excellent workability and productivity.

In accordance with the second aspect of the process of the invention, no penetration of a lubricant, air nor a gas into the space between the core and the jacket occurs during the drawing operation by conducting the vacuum-sucking of the jacket and the core inserted into the jacket one end of which is sealed and after the sealing of the other end, the jacket and the core are clad by conducting the high temperature and high pressure treatment. Accordingly, the bonding strength of the resulting composite wire can be high and stable and no blister is formed on the jacket even when it is employed at an elevated temperature. Since, further, no repetition of the drawing and the annealing is required, the number of processing may be significantly reduced so that the workability and the productivity can be elevated.

DETAILED DESCRIPTION OF THE INVENTION

The material of the pipe (jacket) employed in this invention is not especially restricted provided that the material possesses suitable malleability, however, such a noble metal as platinum or its alloy can be appropriately employed. The material of the core may be any metal or alloy of which malleability may be rather different from that of the jacket. The appropriate material of the core includes molybdenum, tungsten and an Fe-Ni alloy.

The inner diameter of the jacket may be the same as or slightly larger than the outer diameter of the core so as to obtain tight adherence.

The sealing of the jacket may be preferably conducted by means of welding to secure the air-tightness for smoothly conducting the vacuum suction hereinafter mentioned.

The vacuum deaeration can be performed employing a vacuum pump so that the vacuum of degree preferably between $10^{-1}$ and $10^{-5}$ torr. may be achieved.

The hot processing may be hot swaging and hot drawing. The said processing may be performed in accordance with the same conditions as those of the conventional ones.

The resulting composite wire may be further finished by means of tension annealing. When the annealing is carried out at a temperature of 550° to 750° C. and a back tension of 50 to 250 g, the linearity, the mechanical strength, the diameter and the crystal state of the composite wire are made satisfactorily.

If the annealing is conducted below 550° C., the distortion remains so that the linearity cannot be obtained. If the annealing is conducted over 750° C., the crystal particles grows coarse that the sufficient mechanical strength cannot be obtained. If, on the other hand, the back tension is below 50 g, the linearity cannot be obtained. If it is over 250 g, the diameter is made too small.

EXAMPLE

Although Examples of the invention will be described, these Examples are not construed to limit the scope of the present invention.

EXAMPLE 1

After one end of a platium pipe having an outer diameter of 5.2 mm, an inner diameter of 4.8 mm and a length of 500 mm was sealed by welding, a vacuum leakage test was conducted to assure the completeness of the one end sealing. A core having an outer diameter of 4.7 mm and length of 500 mm and composed of Fe-Ni (52% in weight) which had been subjected to alkaline degreasing and washing with an alcohol was inserted into the above platinum pipe similarly subjected to alkaline degreasing and washing with an alcohol. After the degree of vacuum in the platinum pipe was adjusted to $5\times10^{-3}$ torr. by means of a vacuum pump connected to the other end of the pipe, the pipe was processed through six passes of hot swaging until the outer diameter became 2.75 mm. In the processing, the material temperature was maintained between 700° and 800° C. by heating the pipe with a burner. After the vacuum pump was disconnected, the pipe was subjected to draw processing at an ordinary temperature until the outer diameter became 1.0 mm.

COMPARATIVE EXAMPLE 1

After the core of Example 1 was inserted into the platinum pipe of Example 1, the pipe was subjected to draw processing at an ordinary temperature until the outer diameter became 4.5 mm. Then, the pipe was thermally treated in a hydrogen atmosphere at 700° C. for one hour (diffusion annealing) and was subjected to draw processing at an ordinary temperature until the outer diameter become 3.9 mm. Further, the pipe was thermally treated in the same conditions as mentioned above, and then the draw processing at the degree of processing (degree of reduction of section) of 20 to 25% and the thermal treatment at 700° C. for 30 to 60 minutes were repeated to make the outer diameter to be 1.0 mm.

The resulting composite wires of Example 1 and Comparative Example 1 were tested at 800° C. for 30 minutes. While no blister was observed and a diffusion layer was observed in the composite wire of Example 1 as a result of observation of the bonding section, several blisters were observed in the composite wire of Comparative Example 1. The EPMA analysis of the blisters revealed that carbon and oxygen existed therein and the entrainment of the lubricant and the oxidation were proceeding.

EXAMPLE 2

After one end of a platinum pipe having an outer diameter of 5.2 mm, an inner diameter of 4.8 mm and a length of 500 mm was sealed by welding, the pipe was degreased with an alkali and wash with an alcohol. A core having an outer diameter of 4.7 mm and a length of 500 mm and composed of Fe-Ni(52% in weight) on the surface of which a platinum thin layer having a thickness of 2 mm had been coated by a sputtering process was inserted into the above platinum pipe. This pipe was processed by drawing for tight adherence between the jacket and the core until the outer diameter became 5.1 mm. After the degree of vacuum in the platinum pipe was adjusted to $5\times10^{-3}$ torr. by means of a vacuum pump connected to the other end of the pipe while conducting a deaeration treatment at 550° C. for five hours, the other open end of the jacket was sealed by welding. The jacket and the core were clad by conducting the HIP treatment of the composite at 750° C. for five hours and at 1200 kgf/cm$^2$. Thereafter, the composite was subject to draw processing at an ordinary temperature to obtain a composite wire having an outer diameter of 0.5 mm.

COMPARATIVE EXAMPLE 2

A composite wire was prepared in accordance with the procedures of Comparative Example 1 except that the out diameter of the resulting composite wire was made to be 0.5 mm.

The resulting composite wires of Example 2 and Comparative Example 2 were tested at 800° C. for 30 minutes. The same results as those of the comparison between the wires of Example 1 and Comparative Example 1 were obtained.

EXAMPLE 3

A composite wire of which an outer diameter was 0.2 mm having a jacket of which a thickness was 10 to 12 μm was prepared by inserting a rod-like core composed of molybdenum into a platinum pipe to be employed as a jacket, swage-processing, thermally treating and draw-processing the pipe.

EXAMPLE 4

A composite wire of which an outer diameter was 0.2 mm having a jacket of which a thickness was 8 to 11 μm was prepared by inserting a rod-like core composed of an Fe-Ni(52%) alloy into a Pt-Rh(10%) alloy pipe followed by the same treatments as those of Example 3.

EXAMPLE 5

A composite wire of which an outer diameter was 0.2 mm having a jacket of which a thickness was 7 to 13 μm was prepared by inserting a rod-like core composed of molybdenum into a platinum pipe followed by the same treatments as those of Example 3.

COMPARATIVE EXAMPLE 3

A wire composed of a Pt-Rh(10%) alloy was prepared of which an outer diameter was 0.2 mm.

COMPARATIVE EXAMPLE 4

A composite wire was prepared by making a platinum coating having a thickness of 3 μm around a core composed of an Fe-Ni(52%) alloy of which an outer diameter was 0.2 mm.

A temperature cycle test was conducted by repeatedly placing the wires of Examples 3 to 5 and Comparative Examples 3 and 4 in a first condition of an ordinary temperature for 0.5 hour and a second condition of 700° C. and 0.5 hour in an oxygen atmosphere. After 20 cycles were repeated, the strength was measured and the appearance was observed. The results are shown in the below Table I.

TABLE I

| | Tensile Strength (kg/mm$^2$) | | |
|---|---|---|---|
| | Before Test | After Test | Appearance of Surface |
| Example 3 | 100 | 100 | No Change, Excellent |
| Example 4 | 65 | 60 | No Change, Excellent |
| Example 6 | 130 | 130 | No Change, Excellent |
| Comp. Ex. 3 | 58 | 42 | No Change, Excellent |
| Comp. Ex. 4 | 67 | 62 | Black Dots Were Observed |

EXAMPLE 6

A composite clad wire having a diameter of 0.155 mm and composed of Pt (jacket) of which a thickness was 10 μm and an Fe-Ni alloy (core) was prepared in accordance with similar procedures to those of the preceding Examples and was finished at a temperature and back tension specified in Table II. The linearity, the crystal particles, the tensile strength, the hardness and the diameter of the above composite wire were determined. The results are shown in Table II.

TABLE II

| Temperature | Back Tension | Linearity | Crystal Particles | Tension Strength | Hardness | Diameter of Wire |
|---|---|---|---|---|---|---|
| 600° C. | 200 g | 420 mmD | Fine | 85 kg/mm$^2$ | 175 HV | 0.155 mm |
| 700° C. | 100 g | 450 mmD | Fine | 61 kg/mm$^2$ | 162 HV | 0.155 mm |
| 500° C. | 280 g | 150 mmD | Fine | 102 kg/mm$^2$ | 292 HV | 0.146 mm |
| 800° C. | 40 g | 140 mmD | Coarse | 42 kg/mm$^2$ | 130 HV | 0.150 mm |

The standards of the respective factors are as follows.

Linearity: The diameter of the wire is more than 400 mm when 1 m of the composite wire is calmly placed.

Tensile Strength: More than 45 kg/mm$^2$

Hardness: 140 to 180 HV

Diameter of Wire: 0.155±0.005 mmϕ

In accordance with the said standards, the above two wires in Table II are more excellent in linearity, their crystal particles are small, the tensile strengths are high, the hardness is high and the diameters of the wires are pertinent when compared with the two wires in the lower portion of Table II.

What is claimed is:

1. A process of preparing a composite wire which comprises sealing one end of a pipe to be employed as a jacket, inserting a bar to be employed as a core into the pipe and conducting a hot processing of the pipe while vacuum-sucking the pipe from the other end thereof.

2. A process of preparing a composite wire as claimed in claim 1, wherein further comprising finishing the resulting composite wire by means of tension-annealing at a temperature of 500° to 750° C. and back tension of 50 to 250 g.

3. A process of preparing a composite wire as claimed in claim 1, wherein the core is composed of molybdenum, tungsten or an Fe-Ni alloy and the jacket is composed of platinum or its alloy.

4. A process of preparing a composite wire which comprises sealing one end of a pipe to be employed as a jacket, inserting a bar to be employed as a core having an oxidation-resistant thin metal coating on its surface into the pipe, conducting the drawing thereof to tightly stick the pipe with the core, heating it while vacuum-sucking the pipe from the other end thereof to achieve the vacuum deaeration, sealing the other open end of the jacket, then cladding the jacket and the core by means of a high-temperature and high-pressure treatment, and drawing the treated jacket and core.

5. A process of preparing a composite wire as claimed in claim 4, wherein further comprising finishing the resulting composite wire by means of tension-annealing at a temperature of 550° C. to 750° C. and back tension of 50 to 250 g.

6. A process of preparing a composite wire as claimed in claim 4, wherein the core is composed of molybdenum, tungsten or an Fe-Ni alloy and the jacket is composed of platinum or its alloy.

* * * * *